US007095965B2

(12) United States Patent
Hamano et al.

(10) Patent No.: US 7,095,965 B2
(45) Date of Patent: Aug. 22, 2006

(54) IMAGE FORMING APPARATUS

(75) Inventors: Shigemichi Hamano, Chiba (JP); Akihiko Sato, Chiba (JP); Shinichi Takata, Chiba (JP); Toru Ono, Ibaraki (JP); Yushi Oka, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 70 days.

(21) Appl. No.: 10/793,793

(22) Filed: Mar. 8, 2004

(65) Prior Publication Data

US 2004/0234282 A1 Nov. 25, 2004

(30) Foreign Application Priority Data

Mar. 10, 2003 (JP) ..... 2003-063266

(51) Int. Cl.
*G03G 15/08* (2006.01)

(52) U.S. Cl. ..... 399/27; 399/227

(58) Field of Classification Search ..... 399/27, 399/227, 28, 30, 24, 25
See application file for complete search history.

(56) References Cited

U.S. PATENT DOCUMENTS 4,620,783 A * 11/1986 Tanaka et al. ..... 399/27
5,617,198 A * 4/1997 Ishikawa et al. ..... 399/27
5,887,217 A * 3/1999 Mitekura et al. ..... 399/13
6,029,018 A * 2/2000 Rogers et al. ..... 399/12
6,349,183 B1 * 2/2002 Nagamine et al. ..... 399/27
6,381,421 B1 * 4/2002 Katahira ..... 399/27
6,404,996 B1 * 6/2002 Mori et al. ..... 399/24
6,915,090 B1 * 7/2005 Fukaya ..... 399/85
6,915,094 B1 * 7/2005 Tsuruya et al. ..... 399/227
6,917,767 B1 * 7/2005 Kabashima ..... 399/27
6,996,347 B1 * 2/2006 Ito et al. ..... 399/12
7,010,237 B1 * 3/2006 Suzuki et al. ..... 399/27
7,027,746 B1 * 4/2006 Suzuki et al. ..... 399/27

OTHER PUBLICATIONS

U.S. Appl. No. 10/793,772, filed Mar. 8, 2004, Oka, et al.

* cited by examiner

*Primary Examiner*—Diego Gutierrez
*Assistant Examiner*—Amy R. Cohen
(74) *Attorney, Agent, or Firm*—Fitzpatrick, Cella, Harper & Scinto

(57) ABSTRACT

When a plurality of toner containers mounted on a developing rotary unit are simultaneously determined as toner-absent toner containers, toner container replacement may not be efficient because toner containers are replaced at a replacement position. Therefore, when the toner containers mounted on the developing rotary unit are simultaneously determined as toner-absent toner containers, a toner container to be preferentially replaced is selected so as to be able to be placed at a replacement position by considering the usability of the toner containers.

3 Claims, 10 Drawing Sheets

IMAGE FORMING APPARATUS

BACKGROUND OF THE INVENTION

1. Field of the Invention

The present invention relates to an image forming apparatus using an electrophotographic system or electrostatic recording system, particularly to an image forming apparatus for a copying machine, a printer, a facsimile machine, or a complex machine having the functions of these devices.

2. Related Background Art

A full-color-image forming apparatus using an electrophotographic system is hitherto proposed which makes it possible to sequentially execute developing operations by selectively rotating a desired developing apparatus to a developing position by a developing rotary unit mounting a plurality of corresponding toner cartridges (toner containers) together with a plurality of developing apparatuses.

The above image forming apparatus is constituted so as to remove a toner cartridge with no toner among a plurality of toner cartridges from the developing rotary unit and replace it with a new one.

However, when a plurality of toner cartridges runs short of toner or decreases in toner at the same time, a technique is needed which allows a user to replace toner cartridges without confusion of the user by considering the replaceability or usability of the a toner container.

SUMMARY OF THE INVENTION

It is an object of the present invention to provide a high-usability image forming apparatus superior in replaceability of a toner container held by a movable body.

It is another object of the present invention to provide an image forming apparatus improved in usability, by, for example, allowing the time for replacing a toner container held by a movable body to decrease or allowing an image forming job after replacing a toner container to be efficiently executed.

It is still another object of the present invention to provide an image forming apparatus without confusion of a user when replacing toner containers.

The above and other objects of the present invention will become more apparent by reading the following detailed description while referring to the accompanying drawings.

DESCRIPTION OF THE PREFERRED EMBODIMENTS

Embodiment 1

Figure 1:
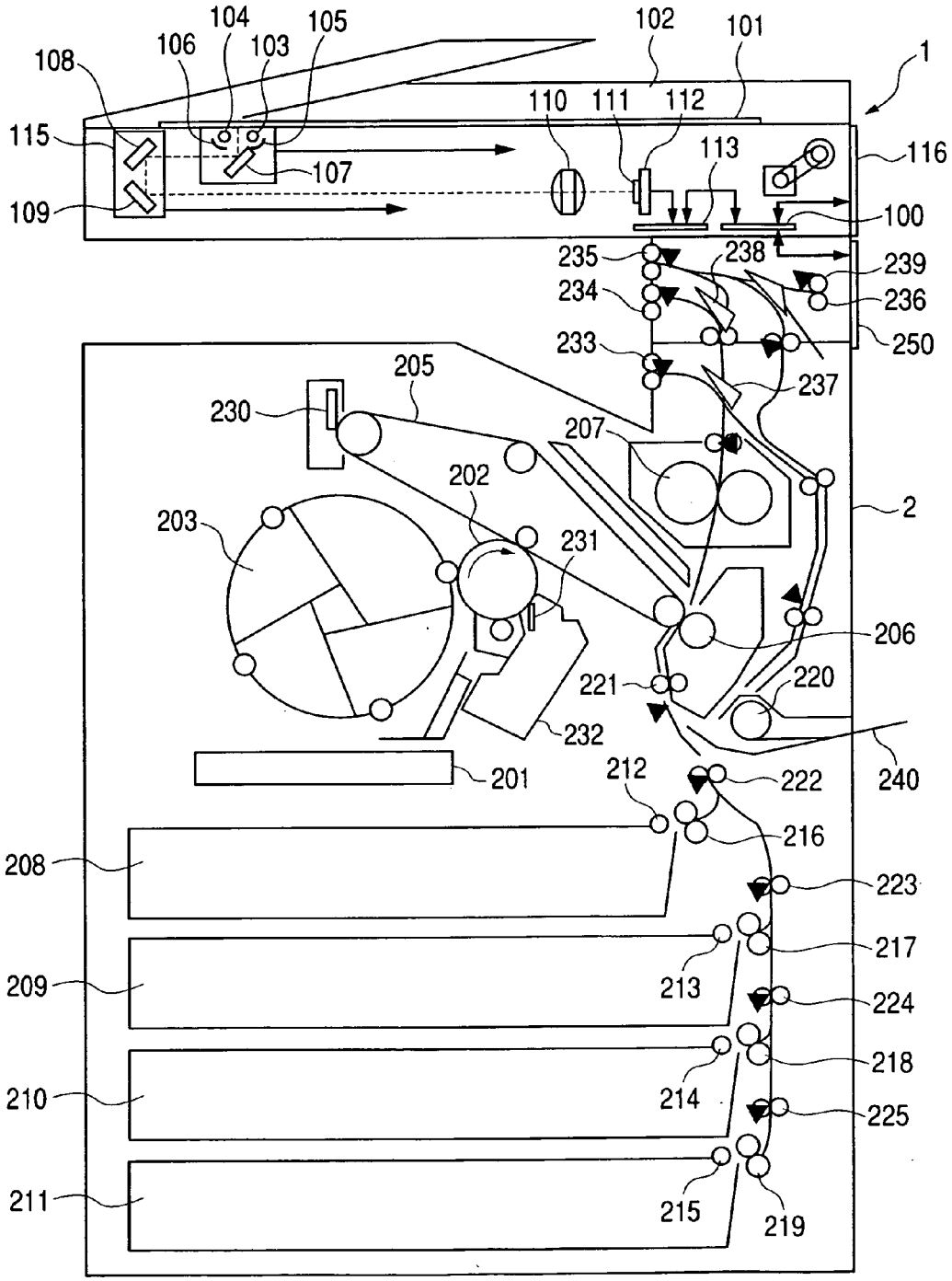
FIG. 1 is an illustration showing a schematic configuration of an image forming apparatus.

FIG. 1 is an illustration showing a schematic configuration of a full-color image forming apparatus which is an embodiment of the present invention. A basic configuration is described below by referring to FIG. 1.

(Image Forming Sequence)

First, a configuration of a color reader portion 1 is described below. Reference numeral 101 denotes original mounting table glass (platen) and reference numeral 102 denotes an automatic original feeder (ADF). It is also allowed to use a configuration for setting a mirror-surface pressure plate or white pressure plate (not illustrated) instead of the automatic original feeder 102. Reference numerals 103 and 104 denote light sources for illuminating an original, which respectively use a light source such as a halogen lamp, a fluorescent lamp, and a xenon tube lamp. Reference numerals 105 and 106 denote reflection umbrellas for condensing the light emitted from the light sources 103 and 104 on an original. Reference numerals 107 to 109 denote mirrors and reference numeral 110 denotes a lens for condensing the light reflected or projected from an original on a CCD (charge coupled device) image sensor (hereafter referred to as CCD) 111. Reference numeral 112 denotes a substrate on which the CCD 111 is mounted, reference numeral 100 denotes a controlling portion or section for controlling the entire image forming apparatus, and reference numeral 113 denotes a printer processing portion (reader scanner controlling portion) including the portion of the image processing portion 113 in FIG. 2 excluding CCD 111 and the portions 301 and 302 in FIG. 2. A carriage for receiving the light sources 103 and 104 and reflection umbrellas 108 and 109 scans the entire surface of an original by mechanically moving in the subscanning direction Y orthogonal to the electrical scanning direction (main scanning direction X) of the CCD 111 at a speed of V/2. Reference numeral 116 denotes an external interface (I/F) to interface with another device.

Figure 2:
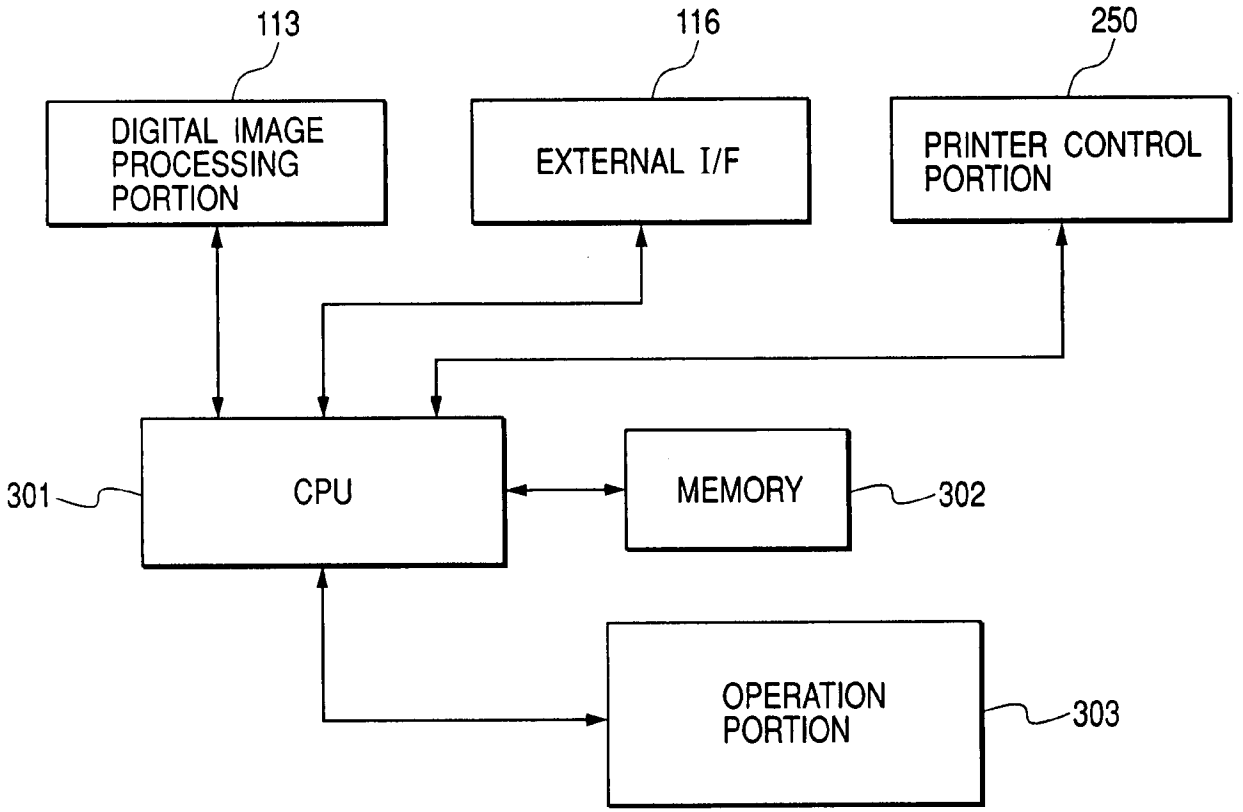
FIG. 2 is a block diagram of a control processing portion of an image forming apparatus.
Figure 3:
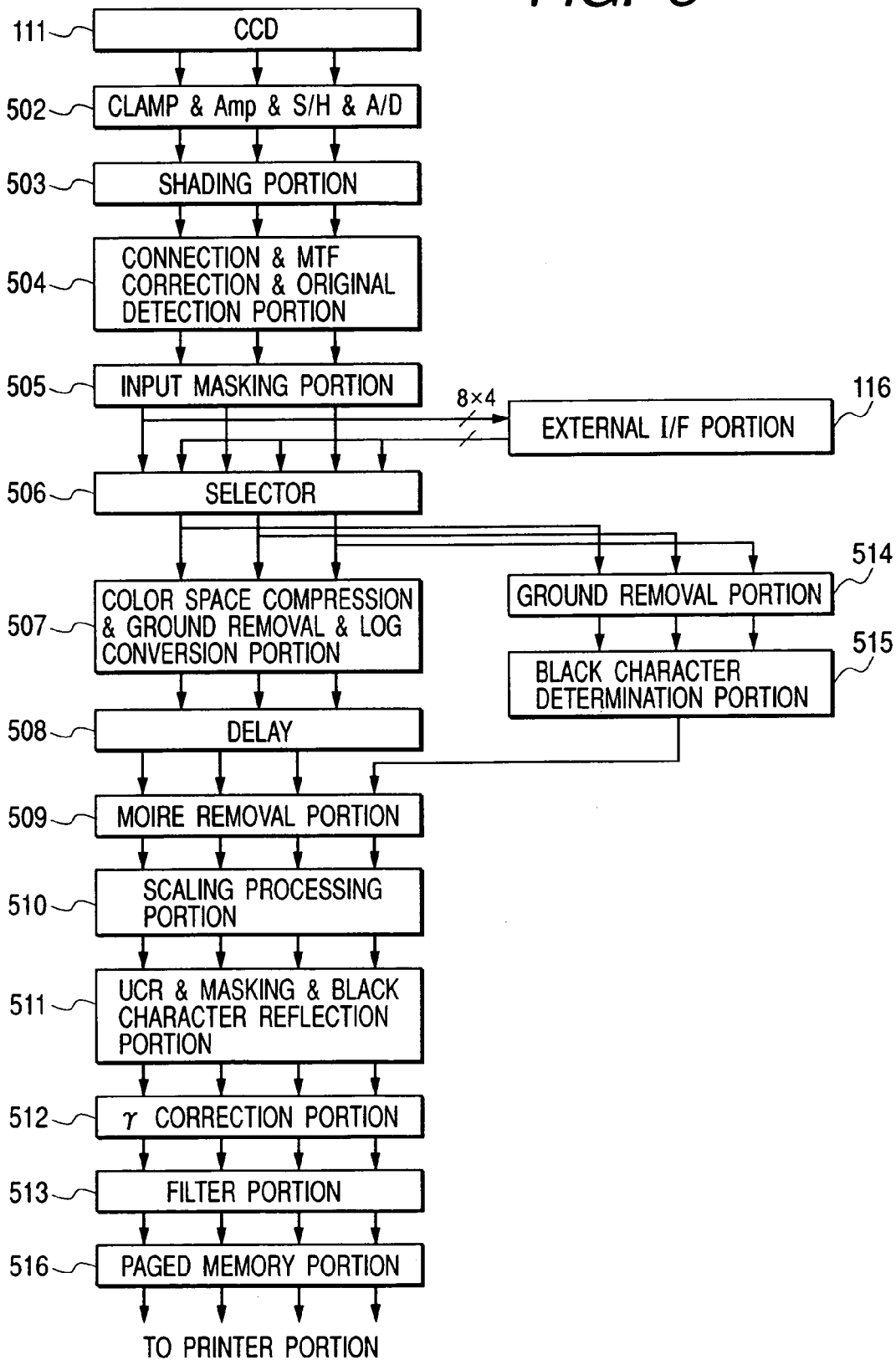
FIG. 3 is a schematic block diagram showing image information processing from CCD input when reading an image up to a printer controlling potion.

Moreover, as shown in FIG. 2, the controlling section 100 is constituted by a CPU 301 having an I/F for exchanging information for performing control with the digital image processing portion 113 and a printer controlling portion 250, an operating portion 303 and a memory 302. The operating portion 303 is constituted by a liquid crystal display provided with a touch panel for inputting processing execution contents by an operator and communicating the information on processing and a warning for the operator.

Figure 4:
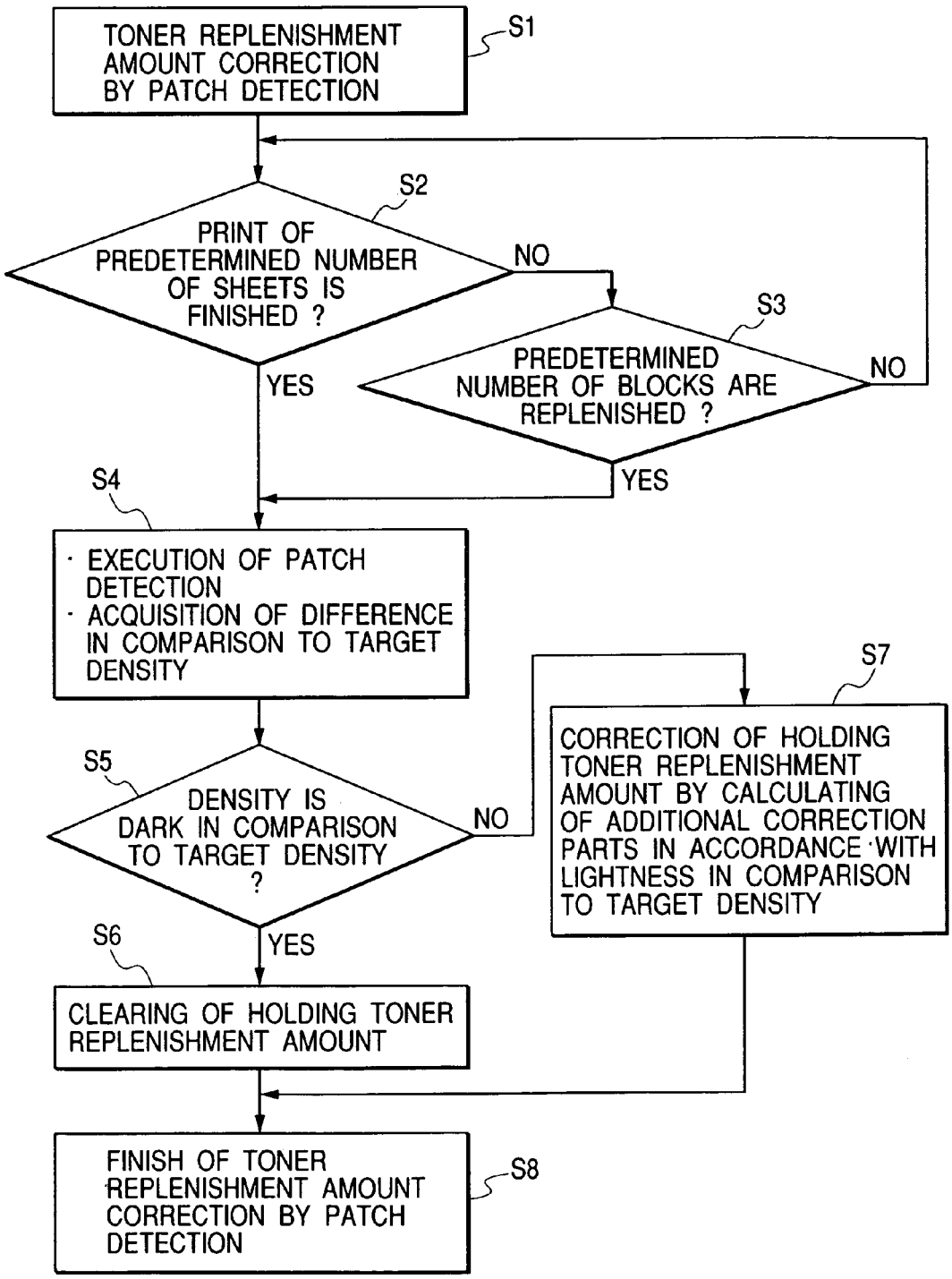
FIG. 4 is a flowchart showing a method of toner replenishment amount correction according to a patch detection result.

Then, the digital image processing portion 113 is described below in detail. FIG. 4 is a block diagram showing a detailed configuration of the digital image processing portion 113.

The light emitted from the light sources 103 and 104 on the original table glass is reflected and the reflected light is guided to the CCD 11 and converted into electrical signals (when the CCD 111 is a color sensor, it is allowed to use a sensor in which color filters of R, G and B are set on a one-line CCD in order in-line, a sensor in which R, G and B filters are arranged for each CCD of a three-line CCD, or a sensor filter is set on a chip or constituted separately from a CCD). Moreover, the electrical signals (analog image signal) are input to the image processing portion 113, sample-held (S/H) by a clamp&Amp&S/H&A/D portion 502 and dark levels of the analog image signals are clamped to a reference potential and amplified to predetermined amounts (the above processing sequence is not always a notation sequence), and the image signals are A/D-converted into, for example, 8-bit digital signals of R, G and B respectively. Then, the R, G and B signals undergo shading correction and black correction in a shading portion 503. Then, a delay amount for each line is adjusted by a bond&MTFcorrection&original detecting portion 503 in accordance with a read speed because in the case of bond processing, a position between lines differs when the CCD 113 is a three-line CCD, signal timing is corrected so that read positions of three lines become the same, a change of MTF for reading is corrected because the MTF for reading depends on a reading speed or power-varying rate in the case of MTF correction, and an original size is recognized by scanning the original on the original table glass in the case of original detection. A digital signal whose read timing is corrected corrects the spectral characteristic of the CCD 111 and spectral characteristics of the originals 103 and 104 and reflection umbrellas 105 and 106 by an input masking portion 505. An output of the input masking portion 505 is input to a selector 506 which can be switched with an external I/F signal. A signal output from the selector 506 is input to a color-space-compression&ground-removal&LOG converting portion 507 and a ground removing portion 514. The signal input to the ground removing portion 514 undergoes ground removal and is then input to a black-character determining portion 515 for determining a black character of an original in the original or not to generate a black character signal from the original. Moreover, the color-space-compression&ground-removal&LOG converting portion 507, which receives an output of the selector 506, determines whether space compression is kept in a range in which a read image signal can be reproduced by a printer. When the space compression is kept in the range, the portion 507 leave the space compression as it is. When the space compression is kept in the range, the portion 507 corrects the space compression so as to enter the range in which an image signal can be reproduced by the printer. Then, the portion 507 performs ground removal processing to convert RGB signals into YMC signals by a LOG converting portion. Moreover, to correct a signal generated by the black character determining portion 515 and its timing, the timing of an output signal of the color-space-compression&ground-removal&LOG converting portion 507 is adjusted in accordance with a delay 508. Moires are removed from these two types of signals by a moir removing portion 509 and power-varied in the main scanning direction by a power varying or scaling processing portion 510. Reference numeral 511 denotes a UCR&masking&black-character reflecting portion. In the case of signals processed by the power varying portion 510, YMCK signals are generated from YMC signals by UCR processing, corrected to signals suitable for output of a printer by a masking processing portion and determination signals generated by the black character determining portion 515 are fed back to YMCK signals. A signal processed by the UCR&masking&black-character reflecting portion 511 is adjusted in density by a γcorrecting portion 512 and then, smoothed or edge-processed by a filter portion 513. The above processed image data is stored in a page memory portion 516 and output to a printer portion in accordance with the image forming timing of the printer portion.

A configuration of a color printer portion 2 will be described. In FIG. 2, reference numeral 250 denotes a printer controlling portion which serves as a receiving port to receive a control signal from the CPU 301 on the controlling portion 100 serving as a controlling portion of the whole image forming apparatus. The controlling portion 100 temporarily stores read image data in the memory 302 on the controlling portion by executing the already-described image-read control for the a color reader portion 1 and transmits the image data in the memory to the printer controlling portion 250 as image data signals by making the data synchronize with a video clock.

The printer portion performs the operation described below in accordance with a control signal output from the printer controlling portion 250. Referring to FIG. 1, reference numeral 201 denotes a laser scanner for emitting a laser beam corresponding to an image data signal to a photosensitive drum 202 in the main scanning direction by a polygon mirror. An electrostatic latent image formed on the photosensitive drum 202 reaches a sleeve position of one color among various colors of a four-color developing rotary unit in accordance with the clockwise rotation of the photosensitive drum 202. Toner corresponding to the potential amount formed between the surface of the photosensitive drum 202 provided with an electrostatic latent image and a developing sleeve face to which a developing bias is applied is flown to the surface of the photosensitive drum 202 from each color developing apparatus 203 and the electrostatic latent image on the surface of the photosensitive drum 202 is developed.

The toner image formed on the photosensitive drum 202 is transferred to an intermediate transfer member rotating counterclockwise in accordance with the clockwise rotation of the photosensitive drum 202. In the case of black single-color images, images are sequentially formed on and primary-transferred onto an intermediate transfer member 205 by keeping a predetermined time interval. In the case of full color images, positioning of the sleeve of a developing rotary unit is applied to an electrostatic latent image corresponding to each color on a photosensitive drum, each electrostatic latent image is developed and primary-transferred, and after the intermediate transfer member 205 rotates four turns, that is, when four colors are primary-transferred, primary transfer of the full color image is completed.

Recording sheets stored in cassettes (upper-stage cassette 208, lower-stage cassette 209, third-stage cassette 210 and fourth-stage cassette 211) are picked up by pickup rollers 212, 213, 214 and 215 of the cassette stages, and the recording sheets are conveyed by sheet feed rollers 216, 217, 218 and 219 up to a resist roller 221 by longitudinal part conveying rollers 222, 223, 224 and 225. In the case of manual sheet feed, recording sheets piled up on a manual sheet feed tray 240 are conveyed up to the resist roller 221 by a manual sheet feed roller 220. Then, with a timing of completing transferring to the intermediate transfer member 205 a recording sheet is conveyed between the intermediate transfer member 205 and a secondary transfer member or roller 206. Thereafter, the recording sheet is held between the secondary transfer member 206 and the intermediate transfer member 205 and conveyed in the fixing-apparatus direction and contact-bonded to the intermediate transfer member 205, and a toner image on the intermediate transfer member 205 is secondary-transferred to the recording sheet. The toner image transferred to the recording sheet is heated and pressured by a fixing roller and pressure roller 207 and fixed to the recording sheet. Transfer residual toner left without being transferred to the recording sheet on the intermediate transfer member 205 is cleaned in accordance with the post-processing control in the latter half of an image forming sequence by scraping the surface of the intermediate transfer member 205 with a cleaning plate 230 which can be contacted with or removed from the surface and scratching the transfer residual toner from the surface of the intermediate transfer member 205. Residual toner is scratched from the drum surfaced by a blade 231 in the photosensitive drum unit and conveyed up to a waste toner box 232 integrated in the photosensitive drum unit. Moreover, positive- and negative-polarity residual toners which are unexpectedly attracted to the surface of the secondary-transfer roller are completely cleaned by alternating applying a secondary transfer positive bias and a secondary transfer negative bias, attracting the residual toners of the both polarities onto the intermediate transfer member 205, and scratching the residual toners by the intermediate-transfer cleaning plate 230 and the post-processing control is completed.

The recording sheet on which an image is fixed is discharged toward a sheet discharge roller 233 by changing the direction of a first sheet-discharge flapper 237 to the first sheet-discharge direction in the case of first sheet discharge. In the case of second sheet discharge, the recording sheet is discharged toward a sheet discharge roller 234 by changing the directions of the first sheet discharge flapper 237 and a second sheet discharge flapper 238 to the second sheet-discharge roller direction. In the case of third sheet discharge, a reverse operation is once performed by a reverse roller 235. Therefore, the directions of the first sheet discharge flapper and second sheet discharge flapper are changed to the direction of the reverse roller 235 to reverse the recording sheet. After the recording sheet is reversed by the reverse roller 235, the direction of a third sheet discharge flapper is changed to the third sheet discharge direction and the recording sheet is discharged toward a third sheet discharge roller 236. In the case of both-side sheet discharge, the recording sheet is once reversed by the reverse roller 235 as with the case of the third sheet discharge, the direction of the third sheet discharge flapper is changed to the both-side-unit direction, and the recording sheet is conveyed to a both-side unit. The recording sheet is once stopped when a predetermined time passes after the sheet is detected by a both-side sensor and then, when an image is prepared, the recording sheet is fed again.

(Toner Replenishing Mechanism)

Figure 10:
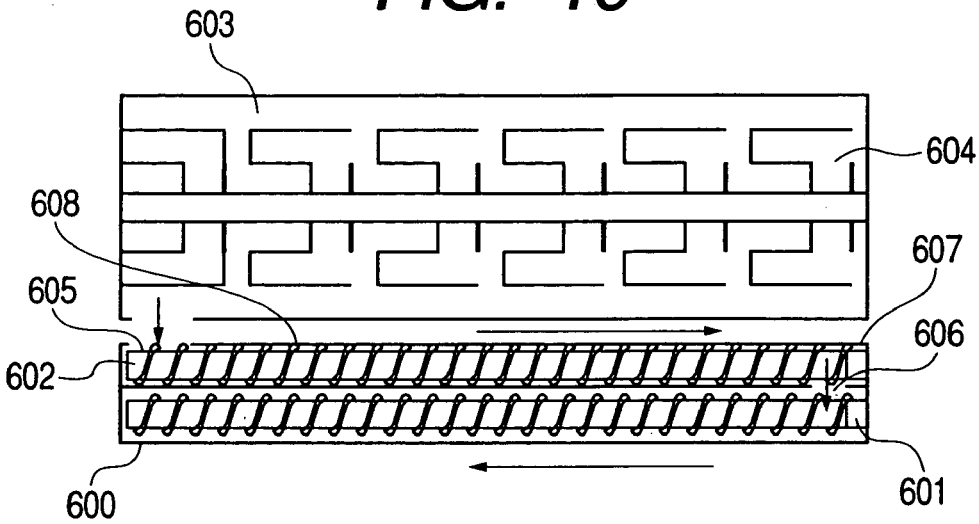
FIG. 10 is a schematic view showing the sides of a toner container and a developing apparatus.

FIG. 10 is an illustration showing schematic views of cross sections of sides of the toner container and developing apparatus of this embodiment. Reference numeral 600 denotes the developing portion of the developing apparatus, reference numeral 603 denotes a toner container, and reference numeral 607 denotes a toner replenishing route serving as a tubular toner-conveying route. Reference numeral 604 denotes a wing for sending toner, reference numeral 605 denotes a replenishing port and a toner-replenishing-route entrance in the toner container, and reference numeral 606 denotes a replenishing port in the toner replenishing route for dropping toner to the developing portion of the developing apparatus from the toner replenishing route. Reference numeral 602 denotes a toner conveying screw for conveying toner through the toner replenishing route, in which a spiral wing 608 is wound on the central axis thereof so as to convey toner up to the replenishing port 606 in the toner replenishing route along the portion of the spiral wing 608 by rotating the toner conveying screw 602. The toner conveying screw 602 is rotatably journaled by being separated by a predetermined distance so as not to contact with the inner periphery of the toner replenishing route in order to prevent toner from becoming coarse grain. Reference numeral 601 denotes an agitating screw for uniformly replenishing the toner in the developing portion 600 in the developing apparatus in the main scanning direction. Arrows in FIG. 10 denote movement directions in which toner is replenished. Toner 609 replenished to the developing portion 600 flows through the developing portion 600 while being agitated by the agitating screw 601.

Figure 11:
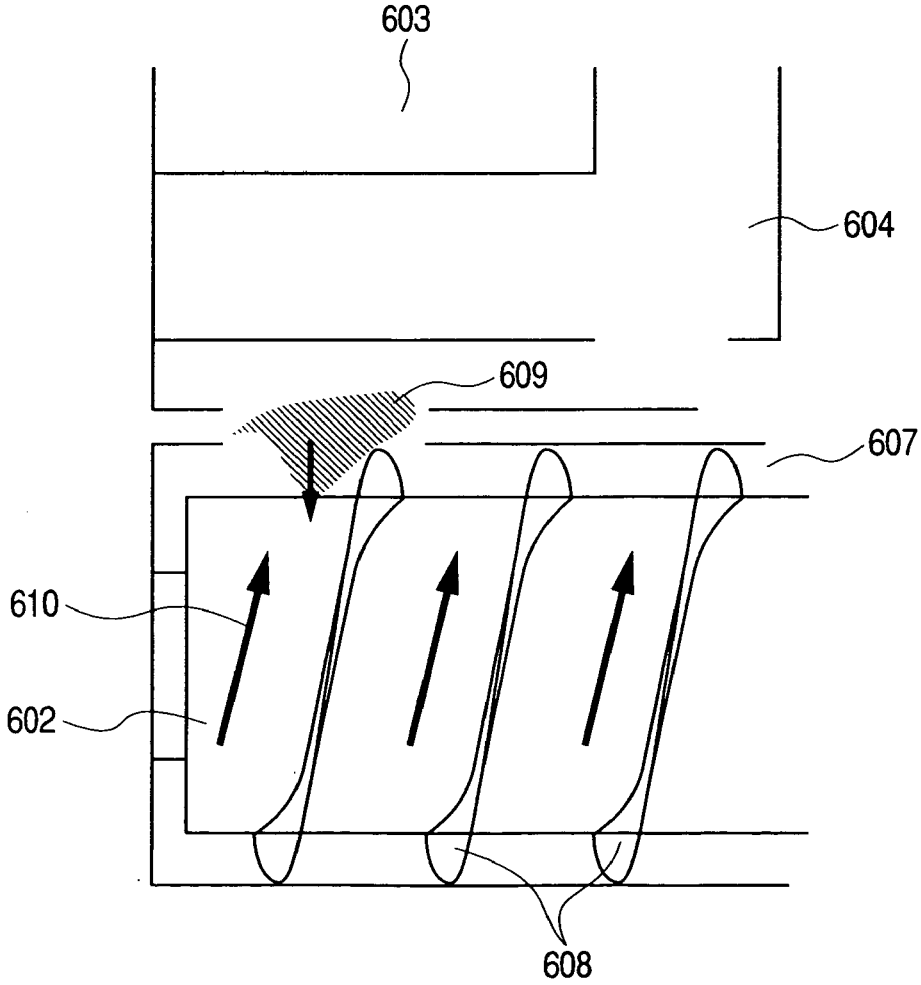
FIG. 11 is an enlarged schematic view showing the replenishment port in a toner container and the entrance of the toner replenishment route in a developing apparatus.

Because a rotational developing rotary unit sequentially moves to developing positions of colors for forming an image in accordance with a printing operation, the rotational developing rotary unit rotates by one turn without fail when forming a full color image. While the rotational developing rotary unit rotates by one turn, the developing unit of each color assumes the state shown in FIG. 10 at a predetermined position different for each color. In this case, toner drops by its own weight through the replenishing port in the toner container and thereby, the toner is replenished into the toner replenishing route predetermined amount by predetermined amount. FIG. 11 shows an enlarged view of the toner operation at the above timing. The replenished toner 609 drops to a position nearby the entrance of the toner replenishing route by its own weight (downward arrow ↓ in FIG. 11). Moreover, when the rotational developing rotary unit is present at a developing position during printing, the toner conveying screw 602 rotates in the direction shown by an arrow 610 in FIG. 11 and thereby, toner is conveyed to the replenishing port 606 in the toner replenishing route along the spiral wing 608.

(Toner Replenishment Control Under Printing)

During printing, a toner replenishment amount is basically decided in accordance with image data information. The image data information denotes basically an integrated value obtained by integrating the information data for toners of various colors for every pixel for each page. Toner consumption of each color is estimated in accordance with the integrated value to decide on a toner replenishment amount. To replenish the decided toner replenishment amount, an operation for driving the toner-conveying replenishing screw 602 of the toner replenishing mechanism in FIG. 11 for a predetermined time and then stopping the mechanism is assumed as one cycle in the case of the replenishment control of this embodiment to calculate a toner replenishment amount in blocks by assuming the one cycle as a block. Thus, it is possible to control the amount of toner actually replenished in accordance with the number of blocks. Therefore, it is possible to easily determine how toner is consumed as a whole and easily estimate a replenishment fluctuation compared to the case of simply replenishing toner for a replenishment time. Moreover, for a toner replenishment amount, a phenomenon that toner replenishment is too late for an actual necessary toner amount or a phenomenon that toner is excessively replenished occurs when continuous printing different in image density duty is performed in accordance with only an estimated toner replenishment amount. Therefore, colors are corrected for every block replenishment (patch detection control) by forming a patch for each color on the photosensitive drum 202 in FIG. 1 for every predetermined interval and directly detecting the toner density.

FIG. 4 shows a toner replenishment amount correction method according to patch detection. Toner replenishment amount correction (S1) according to patch detection is determined in accordance with whether printing is performed at a predetermined interval during printing. When determining whether printing of a predetermined number of sheets is completed (S2) and printing of a predetermined number of sheets is completed, patch detection is executed synchronously with the next page (S4). Moreover, when printing of a predetermined number of sheets is not completed but an image having an image density duty is formed under continuous printing, the necessary toner replenishment amount increases by an amount necessary for the image. Therefore, by assuming the above case, it is determined whether toner is replenished by a predetermined number of blocks (S3) to execute patch detection when toner is replenished by a predetermined number of blocks (S4). In the case of this embodiment, it is possible to form a patch for executing patch detection at the front end of each color image when forming a full color image. Therefore, it is possible to execute patch detection synchronously with full-color image formation. As a result of executing patch detection, detecting a formed patch, and calculating a patch density, the patch density is compared with a target patch density previously decided for each color to calculate the difference from the target density (S4). It is then determined whether the calculated patch density is higher than the target density (S5). When it is determined that the calculated patch density is higher than the target density, a necessary number of toner blocks to be replenished held at the timing are cleared (S6)).

When it is determined that the calculated patch density is lower than the target density, an additional correction amount is calculated in accordance with the difference from the target density calculated in (S4) to additionally correct a toner replenishment amount (S7) and the toner replenishment amount correction according to patch detection is completed (S8)

(Toner-Absence Detecting Method Under Printing)

Figure 5:
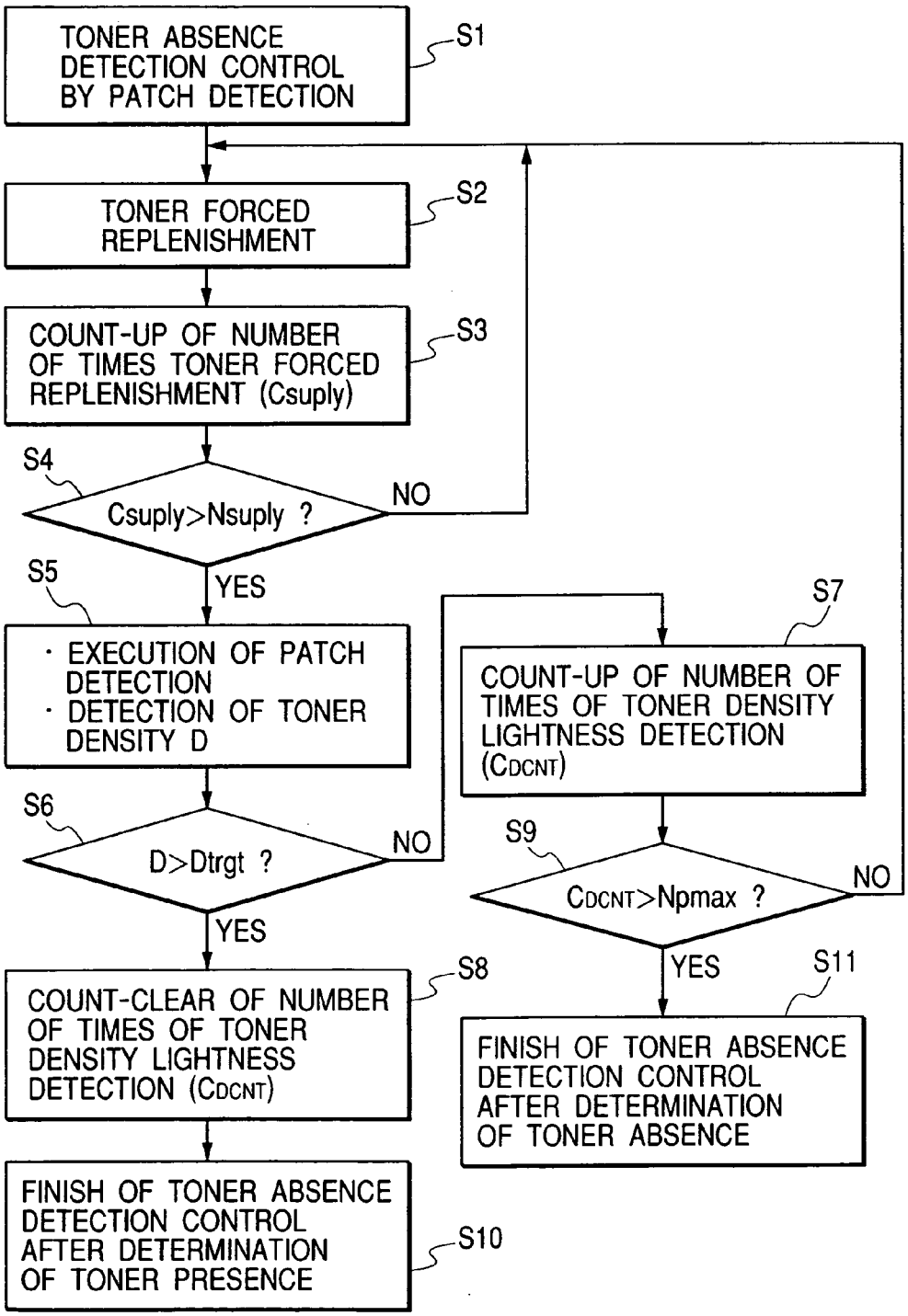
FIG. 5 is a flowchart showing toner-absence detection control flow.

The toner-absence detecting method of this embodiment is executed by the patch detection described for the above toner replenishment control. Patch detection is normally executed to correct a toner replenishment amount. However, when the residual toner amount is small, a toner density detected by patch detection also decreases. Therefore, this phenomenon is used. FIG. 5 shows a toner-absence detection control method. Patch detection control is executed when a predetermined interval is reached or when the number of toner blocks to be replenished reaches a predetermined number of blocks. In this case, when it is detected that the patch density is low, toner-absence detection control is executed (S1). Toner replacement is first forcibly executed (S2), the forcible toner replacement frequency is counted (S3), and forcible toner replacement is repeatedly executed until a predetermined forcible replacement frequency Nsuply is completed (S4). After the predetermined forcible replacement frequency is completed, patch detection is executed to calculate the then patch density D (S5). The patch density D is compared with a target patch density Dtrgt (S6). When the patch density D is higher than the target patch density Dtrgt, it is determined that toner is present to clear a toner-density detection frequency CDCNT. To forcibly execute toner replacement, a toner density must return when toner is present. However, when the residual toner amount is small or toner is absent, a toner density must not easily return. Therefore, when the patch density D is lower than the target patch density Dtrgt, the toner density detection frequency CDCNT is counted up (S7) to repeatedly execute toner replacement from the forcible toner replacement. When the patch density D is continuously lower than the target patch density Dtrgt up to a predetermined frequency Npmax, it is substantially determined that toner is absent. By using the above configuration, it is possible to detect toner absence also in a system having no residual-toner-amount detecting sensor.

(Residual Toner Amount Detecting Method Under Printing)

The residual toner amount detecting method of this embodiment is executed by integrating the toner block replacement frequency described for the above toner replacement control. It is previously decided through an experiment or the like what value a toner block replacement frequency has in terms of the above block replacement unit before toner runs out. When assuming the frequency as A (number of blocks) and an integrated frequency of actually-executed block replacement as B (number of blocks), the following expression is used.

Residual amount (%)=(A−B)/A×100

In the case of this embodiment, it is determined that a residual toner amount is small when the residual toner amount is lower than 25%.

(Operations of Rotational Developing Rotary Unit when Detecting Toner Absence)

In the case of this embodiment, when toner absence is detected by the toner absence detecting method while a job is executed, an image is formed on a sheet currently fed to discharge the sheet, sheet feeding is stopped for sheets from the above sheet downward, post-rotation processing, such as cleaning, is executed for the process processing relating to image formation, and a motor load currently driven is stopped.

The currently-driven motor load also includes a developing rotational rotary unit. When the normal job is completed, a rotational developing rotary unit not at the developing position of each color is moved up to the takeout position of a color for toner absence simultaneously with the post-rotation processing of process processing, though the rotary unit is normally moved up to the home position which is not the developing position for each color and the rotation reference position of the rotary unit.

In addition, in the present embodiment, the toner-absence detecting is performed sequentially with respect to the respective toner containers of yellow, magenta, cyan and black toner. And even if the toner container which is determined as having the status of "toner absence" is detected in the middle of the toner-absence detecting, the toner-absence detecting is performed as one process until the toner-absence detecting is completed with respect to all of the toner containers.

Accordingly, according to the structure of the present embodiment, as described below, when the plurality of the toner containers are determined as having the status of "toner absence" at the same time, it can shorten the time required to replace all of the toner containers which are determined to have the status of "toner absence," as much as possible.

Because, when one toner container is replaced and the door for exchange is closed, the CPU controls the apparatus so that the operation for preparation required to perform the image forming, such as the toner presence/absence detection with respect to the exchanged toner container, is performed.

Moreover, in the case of toner absence of only one color, the toner container of a color whose toner is absent is moved to the takeout position.

Furthermore, when toner absence of a plurality of colors occur at the same time and black is included in the colors whose toners are absent, a black toner container is preferentially moved to the replacement position (takeout position) together with the rotational developing rotary unit. This is because when black toner runs out, the printer portion 1 of this embodiment basically becomes a state not capable of forming an image.

Figure 6A:
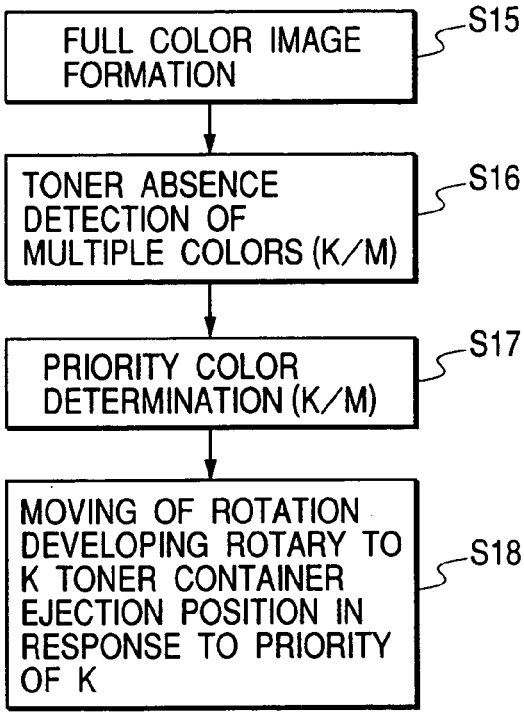
FIG. 6A is a flowchart showing a method for moving a developing rotary unit to a toner container ejection position when the absence of a plurality of color toners including absence of black toner occurs.

FIG. 6A shows a method involving a toner-container takeout position of a developing rotary unit when black and magenta toners run out.

When black is not included in a color whose toner runs out, that is, among a plurality of colors other than black whose toner containers substantially include no toner, the toner container of the nearest color for control is preferentially moved to the takeout position. That is, a toner container nearer to a toner container takeout position (toner container nearest at the upstream side of a toner-container takeout position in the rotational direction of a developing rotary unit) when starting a toner container replacing step is preferentially moved to accelerate replacement of a corresponding toner container at a liquid-crystal displaying portion located above an image forming apparatus. Thereafter, a user opens the replacement door of the image forming apparatus, takes out the corresponding toner container located at the takeout position of the developing rotary unit, and replaces the toner container with a new toner container. Therefore, because the toner container of the nearest color among colors whose toners run out is moved to the takeout position, the user does not have to wait and it is not necessary to wastefully rotate the developing rotary unit. That is, it is possible to minimize the time required for the toner-container replacing step.

Figure 8A:
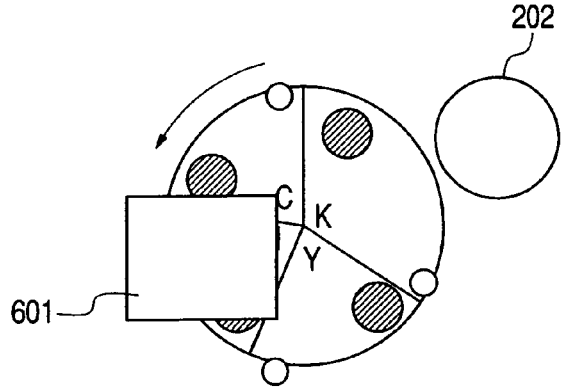
FIG. 8A is a schematic illustration showing the normal home position of a developing rotary unit.
Figure 8B:
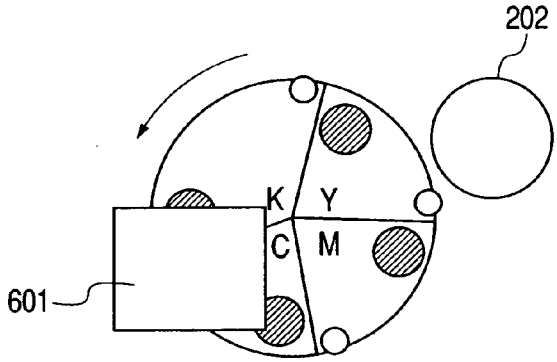
FIG. 8B is a schematic illustration showing the home position of a developing rotary unit when a full color image is formed and a final color image formation is completed.

Image formation in this embodiment is executed in order of yellow, magenta, cyan and black. FIG. 8A shows a state in which a developing rotary unit is present at the normal home position and FIG. 8B shows a developing rotary unit position state after full color image formation is completed. In FIGS. 8A and 8B, the gray round portions show a toner container of each color. When considering the control in which the rotational speed and rotational direction of a developing rotary unit are restricted in only one direction on completion of the black image formation, the color order nearest to a toner-container takeout position after forming an image is shown as black, yellow, magenta and cyan illustrated in FIG. 8B. That is, the priority for taking out toner containers is shown below.

Black→Yellow→Magenta→Cyan

Figure 6B:
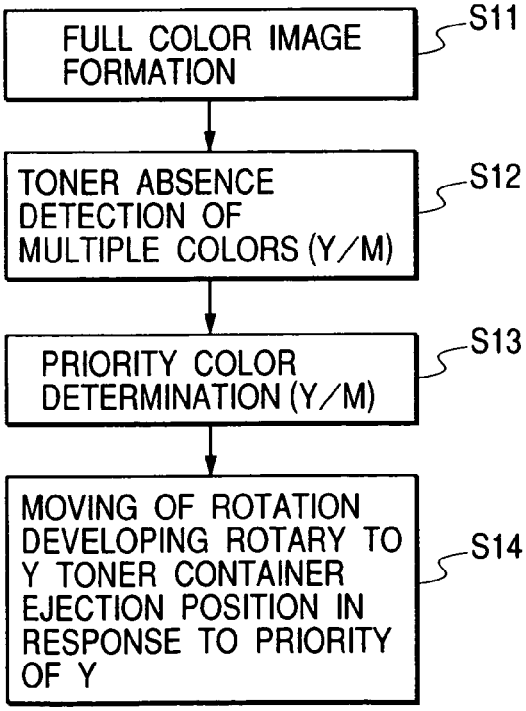
FIG. 6B is flowchart showing a method for moving a developing container to a toner container ejection position when the absence of a plurality of color toners excluding absence of black toner occurs.

FIG. 6B shows a method for deciding a toner container takeout position of a developing rotary unit when toners of yellow and magenta run out at the same time.

Moreover, it is also allowed to use a configuration of moving an apparatus to the position for taking out the toner container of a preferential color by considering the image forming job of the next black single color and assuming a color whose stop position is the nearest to a black developing position as a preferential color immediately before stopping the apparatus when toner absences of a plurality of colors except black are simultaneously detected. In this case, there are market needs for executing a black single-color job even when color toners are absent and it is an object to set the first print-out time or first copy-out time of a black single-color job when there is no color toner as early as possible. In this case, the priority of colors under toner absence is shown below.

Black→Magenta→Yellow→Cyan

Figure 8C:
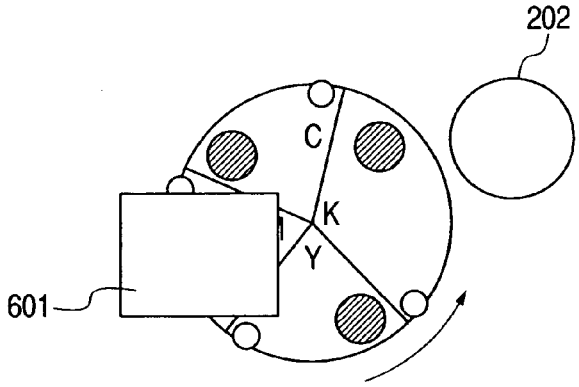
FIG. 8C is a schematic illustration showing a magenta-toner-container ejection position.

FIG. 8C shows a developing rotary unit position at the magenta-toner takeout position. When starting printing at the position in FIG. 8C, it is possible to earliest reach the black toner developing position compared to the case of starting with the toner-container takeout position of another color.

After replacing toner containers, toner container replacement and toner initialization control are executed for every color by executing the toner initialization control of a color whose toner container is replaced and confirming the return of a toner density. After the toner density returns by the toner initialization control, the toner container is stopped at a toner-absent color container having the second priority. Details of the toner initialization control will be described later.

(Toner Container Replacement Determining Method Under Toner Absence Detection)

In the case of this embodiment, a dedicated sensor for detecting whether a toner container is taken out is not mounted.

Therefore, in the case of this embodiment, when a toner container receiving the toner of a color whose toner substantially runs out in accordance with the above method is present at the takeout position, a CPU determines that a user replaces toner containers by detecting that a small window serving as an opening/closing door which can be freely opened or closed in order to take out a toner container from a developing rotary unit is released from a state in which the window is closed and the opening opens.

That is, in the case of this embodiment, the CPU determines "replacement of toner containers" in accordance with the "small window opening operation".

Figure 7:
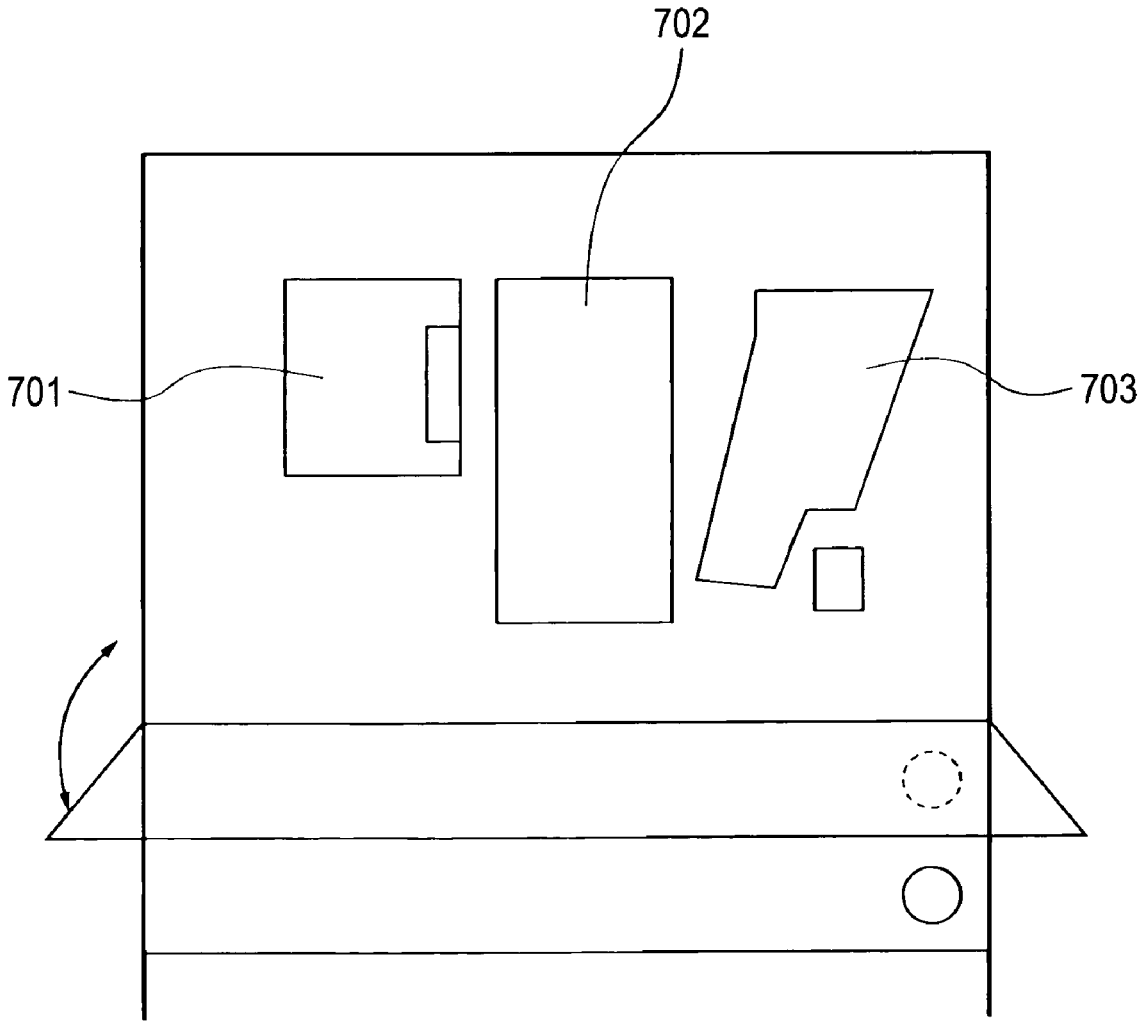
FIG. 7 is a schematic view of a toner replacing small window.

FIG. 7 shows an outline of a toner-container-takeout small window which must be opened without fail when replacing toner containers. Symbol 701 denotes a small window for taking out a toner container, 702 denotes a waste toner receiving box, and 703 denotes a photosensitive drum unit. The toner container is taken out by opening the toner-container takeout small window 701 to this side and turning a not-illustrated toner-container replacing lever seen by opening the small window. When every door closes after replacing toner containers, the toner initialization control of the color whose toner runs out is executed in addition to the preparation processing up to a printing acceptable state which is normally executed. Details of the toner initialization control will be described later.

(Initialization Control after Replacing Color Toner Container Including No Toner)

Figure 9:
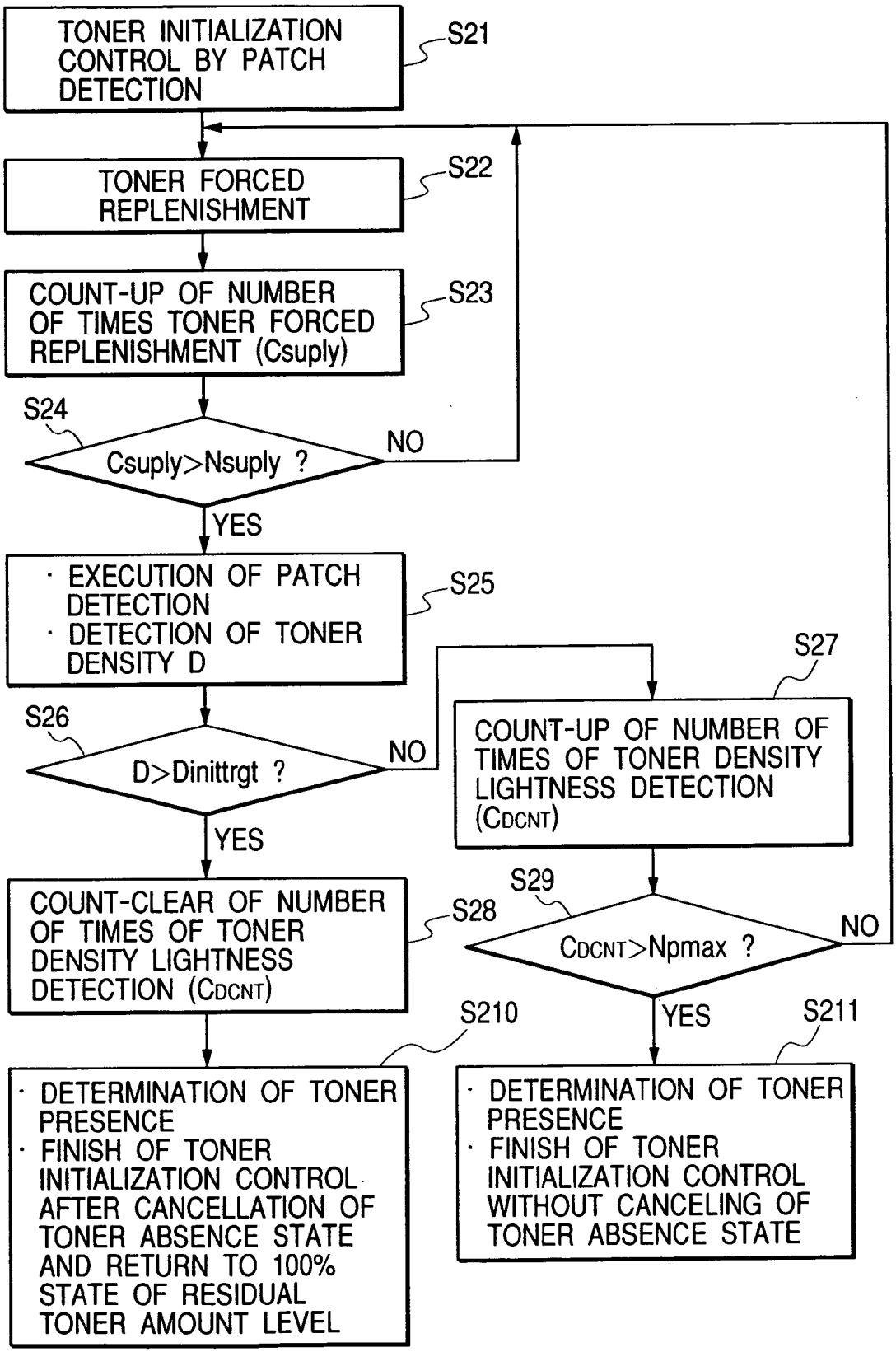
FIG. 9 is a flowchart showing a toner initialization control method immediately after replacing toner.

After replacing a color toner container in which toner runs out, it is necessary to execute the processing for determining whether the toner density returns without fail. When it is possible to accurately detect the residual toner amount at the toner replenishing port in a not-illustrated developing apparatus, it is not necessary to detect that the toner density returns. In the case of this embodiment, however, the above patch detection control is executed because a sensor for accurately detecting the residual toner amount at the toner replenishing port in the developing apparatus is not included. Basically, toner is forcibly replenished into the developing apparatus and patch detection control is executed to detect whether a toner density reaches a target density at the time of predetermined return as with the case of toner absence detection. FIG. 9 shows a toner initialization control flow. The toner initialization control is different from the normal toner absence detection control in that a target density Dinittrgt to be compared with a patch density D detected through patch detection is made lower than the target density Dtrgt under toner-absence detection control. This is because the fact that a target density is extremely raised when toner returns becomes a user claim that an image density fluctuation increases. By lowering a target density compared to the case of toner-absence detection control, the toner density to be returned is lowered. When reaching the target density Dinitrgt, the toner absence state is cancelled to complete the toner initialization control.

Embodiment 2

(Toner Container Replacement Positioning Control According To Selection by User)

Figure 6C:
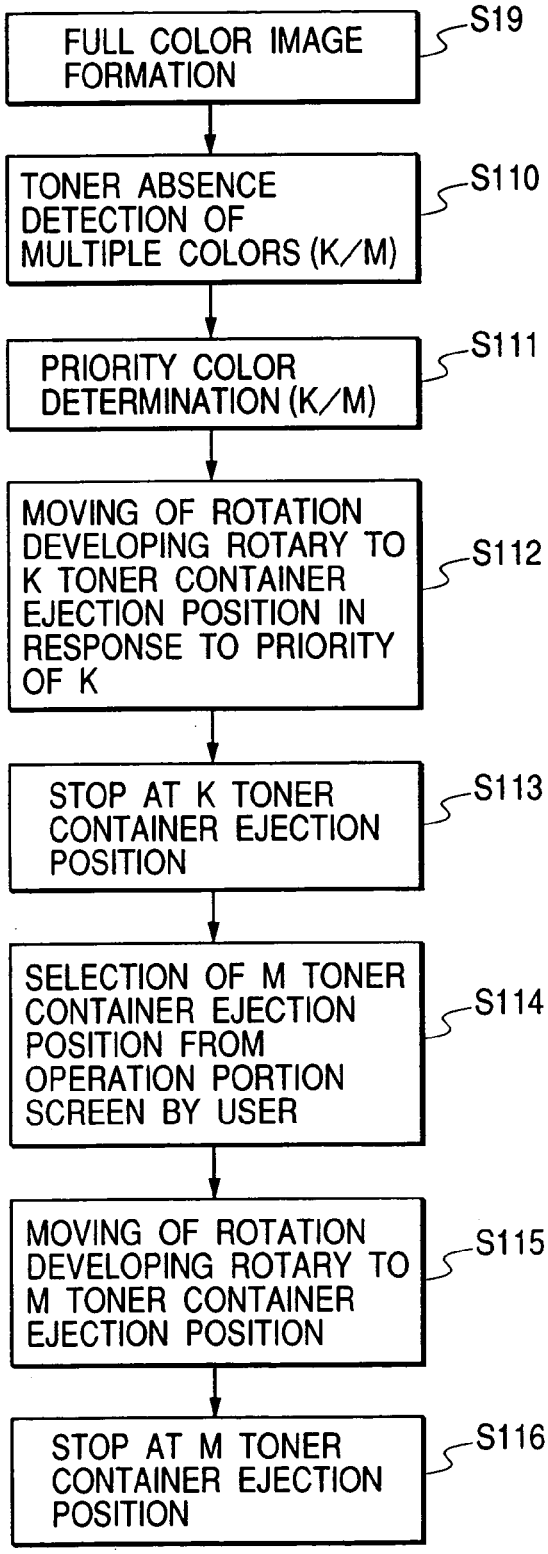
FIG. 6C is a flowchart showing a method for providing a selected color key-input by a user from an operating portion and moving a developing rotary unit to a toner container ejection position.

When toner absence of a plurality of colors occurs at the same time and a toner-absent color is selected through key input by a user from an operating portion, the toner container of the selected color is moved to a takeout position. Also when a preferential color is once determined and the toner container of another color is moved to the takeout position, the toner container of the color selected by the user is moved to the takeout position. FIG. 6C shows a method for moving the toner container of a color selected by a user to a takeout position. Though a toner container receiving black toner is once moved to the takeout position, the toner container receiving magenta toner is moved to the takeout position through key selection at the operating portion by the user. In this case, for the toner initialization control to be executed immediately after replacing toner containers, it is a matter of course to give priority to the toner initialization on the toner of the color selected by the user. After a toner density is returned by the toner initialization control of the color selected by the user, the toner container of another toner-absent color having the next priority is moved to the takeout position and stopped. Details of the toner initialization control are previously described.

(Processing After Replacing Toner Containers in the Case of Forcible Replacement of Toner-Present Colors by User)

When it is determined through residual toner detection that the density toner is small and thereby, toner containers are replaced to execute the toner initialization control, a mixing rate between toner and carrier in the developing apparatus is greatly changed and thereby a sudden image-density fluctuation occurs due to forcible toner replenishment executed through the toner initialization control because toner is present in the developing apparatus though it is little at this point to time. Moreover, the same is applied to the case in which toner is present and it is forcibly replaced. Therefore, in the case of this embodiment, when it is determined that is at least present, toner forcible replacement color is selected by the user from the operating portion and the toner-container replacement takeout small window is detected and thereby, it is determined that the user has an intention of replacing toner containers and it is executed only to return a residual toner level to a full state so as not to execute the toner initialization control.

In the case of the above embodiment, though a "state in which a toner container is determined as a toner-absent toner container" is expressed, this does not indicate only that toner in a toner container is completely absent, but in the case of the present invention, it also indicates a case in which toner slightly remains in a toner container and is referred to as "toner absence". That is, when it may be better to replace toner containers, a the state of a toner container is referred to as a "toner absent state".

Moreover, the above embodiment is constituted so that a toner container to be replaced by a user at an operating portion can be selected. However, it is also allowed to use the following configuration in addition to or instead of the above configuration.

Specifically, the configuration is a configuration in which a toner container to be replaced by a user is selected from a computer network connected with an image forming apparatus and a signal showing the specified toner container is input to the CPU 301 through a network and the interface portion 116 is set to the image forming apparatus so as to control operations of a developing rotary unit in accordance with the input signal.

Moreover, a system for detecting the residual toner amount in a toner container is not restricted to the above configuration but it is allowed to use a configuration of setting an optical sensor having a light-emitting portion and a light-detecting portion nearby a developing rotary unit, projecting light toward a toner container from the light-emitting portion of the optical sensor and detecting the light reflected from the toner container by the light-detecting portion. Furthermore, it is allowed to use a system of using that image information of an original image (when functioning as a printer, image information transmitted from a network-connected computer is used) that corresponds to the used amount of a developer, thereby detecting a residual toner amount in a toner container. The image information signal undergoes various signal processing operations and then it is output to a laser scanner 201 serving as the above exposing apparatus so that an electrostatic latent image corresponding to image information is formed on a photosensitive member.

It is also allowed to set a plurality of sensors for respectively detecting the residual toner amount in a toner container every a plurality of toner containers.

As described above, according to each of the above embodiments, it is possible to provide an image forming apparatus improved in usability and capable of shortening the time required for a toner replacing step as soon as possible or efficiently executing an image forming job after replacing toner containers. Moreover, it is possible to provide an image forming apparatus not confusing a user when replacing toner containers.

What is claimed is:

1. An image forming apparatus comprising:

a plurality of developing devices each of which develops an electrostatic image on an image bearing member with a toner of color different from each other;

a plurality of toner containers each of which receives the toner of color different from each other for replenishing the developing devices;

moving means, which holds the toner containers, for moving a selected toner container among the toner containers to a replacement position for replacing toner containers;

operation control means for performing operation control of said moving means so as to move a toner container selected by an operator to the replacement position;

detection means for detecting residual toner amounts in the toner containers; and initialization control means being capable of initialization control for detecting residual toner amounts by said detection means after replacing a toner container and forcibly performing replenishing toner from the replaced toner container into a corresponding developing device, wherein, when a toner container which is determined as having no toner therein is moved to said replacement position by said operation control means, said initialization control means performs said initialization control after replacing a toner container, and when a toner container which is determined as having toner therein is moved to said replacement position by said operation control means, said initialization control means does not perform said initialization control after replacing a toner container.

2. An image forming apparatus according to claim 1, further comprising inputting means for inputting information concerning the selected toner container.

3. An image forming apparatus according to claim 2, further comprising an operating portion capable of selecting a toner container by an operator, wherein said operating portion outputs the information concerning the selected toner container to said inputting means.

* * * * *

UNITED STATES PATENT AND TRADEMARK OFFICE

CERTIFICATE OF CORRECTION

PATENT NO. : 7,095,965 B2
APPLICATION NO. : 10/793793
DATED : August 22, 2006
INVENTOR(S) : Shigemichi Hamano et al.

It is certified that error appears in the above-identified patent and that said Letters Patent is hereby corrected as shown below:

COLUMN 1
Line 55, “potion;” should read --portion;--.
Line 64, “occurs,” should read --occurs;--.

COLUMN 3
Line 56, “leave” should read --leaves--.

COLUMN 4
Line 13, “γcorrecting” should read --γ correcting--.

COLUMN 8
Line 13, “must” should read --will--.

COLUMN 9
Line 17, “occur” should read --occurs--.

COLUMN 11
Line 23, “Dinitrgt,” should read --Dinittrigt,--.
Line 63, “to” should read --in--.
Line 66, “that” should read --that the toner--.

Signed and Sealed this

Twenty-sixth Day of June, 2007

JON W. DUDAS
*Director of the United States Patent and Trademark Office*